US005443122A

United States Patent [19]

Brisco

[11] Patent Number: 5,443,122

[45] Date of Patent: Aug. 22, 1995

[54] PLUG CONTAINER WITH FLUID PRESSURE RESPONSIVE CLEANOUT

[75] Inventor: David P. Brisco, Duncan, Okla.

[73] Assignee: Halliburton Company, Duncan, Okla.

[21] Appl. No.: 286,770

[22] Filed: Aug. 5, 1994

[51] Int. Cl.[6] ..... E21B 33/05

[52] U.S. Cl. ..... 166/285; 166/70; 166/386

[58] Field of Search ..... 166/386, 285, 70, 153, 166/155

[56] References Cited

U.S. PATENT DOCUMENTS

| | | | |
|---|---|---|---|
| 3,322,197 | 5/1967 | Baker et al. | 166/75 |
| 3,444,928 | 5/1969 | Pitts | 166/70 |
| 3,863,716 | 2/1975 | Streich | 166/70 |
| 3,971,436 | 7/1976 | Lee | 166/70 |
| 4,290,482 | 9/1981 | Brisco | 166/70 |
| 4,574,882 | 3/1986 | Szarka | 166/75.1 |
| 4,624,312 | 11/1986 | McMullin | 166/155 |
| 4,671,353 | 6/1987 | Daming | 166/70 |
| 4,809,776 | 3/1989 | Bradley | 166/153 |
| 4,934,452 | 6/1990 | Bradley | 166/153 |
| 4,995,457 | 2/1991 | Baldridge | 166/70 |
| 5,040,603 | 8/1991 | Baldridge | 166/291 |
| 5,095,808 | 3/1992 | Baldridge | 92/24 |
| 5,095,988 | 3/1992 | Bode | 166/70 X |
| 5,236,035 | 8/1993 | Brisco et al. | 166/70 |
| 5,293,933 | 3/1994 | Brisco | 166/70 |

FOREIGN PATENT DOCUMENTS

| | | | |
|---|---|---|---|
| 1234583 | 5/1986 | U.S.S.R. | 166/70 |

*Primary Examiner*—Hoang C. Dang
*Attorney, Agent, or Firm*—Stephen R. Christian; E. Harrison Gilbert, III

[57] ABSTRACT

A plug container, such as can be used during a cementing operation at an oil or gas well, includes one or more plug holders which seal against a bypass sleeve when the plugs carried in the holders are released to separate columns of fluid pumped into the well. The bypass sleeve is responsive to fluid pressure so that when sufficient fluid pressure is applied to the bypass sleeve, it lifts the plug holder(s) and uncovers one or more cleanout ports in at least one plug holder. The uncovered cleanout port(s) allow residue fluid, such as cement, to flow out of the plug container. The pressurized fluid can be applied through a hose connected to a single structural member of the plug container so that the hose does not need to be disconnected when the remainder of the plug container is being assembled or disassembled.

8 Claims, 7 Drawing Sheets

PLUG CONTAINER WITH FLUID PRESSURE RESPONSIVE CLEANOUT

BACKGROUND OF THE INVENTION

This invention relates to a plug container used in the introduction and separation of fluids in a well, such as the introduction and separation of cement slurry and displacing fluid in an oil or gas well. The plug container permits residue fluid, such as cement, to be cleaned from the plug container in response to a pressurized fluid lifting a bypass member and one or more plug holders disposed in the plug container.

Cement is used in oil or gas wells for various purposes. One purpose is to secure a tubular string (e.g., a casing or a liner) in the well bore. This is typically done by pumping cement down the tubular string and forcing it back up an annular space between the outside of the string and the well bore or a larger diameter string in which the first-mentioned string is disposed. To separate the cement slurry from drilling mud typically in the well when the cementing operation begins, a bottom cementing plug is placed in line and pumped down the string by the force of the following cement slurry. This bottom plug serves to minimize contamination of the cement as it is being pumped down the tubular string. It also wipes any accumulated mud film from the inner diameter of the string and pushes it ahead. To separate a following displacing fluid used to push the cement slurry out the tubular string and up the annular space, a top cementing plug is placed in line and pushed down the string by the displacing fluid. This top plug follows the cement and wipes any accumulated cement film from the inner diameter of the tubular string. It also prevents or reduces any contamination of the cement by the displacing fluid.

In wells drilled on land, surface-mounted plug containers are used in many cementing jobs to release the cementing plugs at the proper time. Normal job operations will have the bottom cementing plug loaded into the plug container prior to pumping cement. The top cementing plug will typically be loaded after the bottom plug is released. If well conditions dictate, two plug containers or a double plug container may be used to release both cementing plugs when desired without opening the plug container.

Subsea (ocean floor) completions are different from the aforementioned land-based cementing operations in that the cementing plugs used for separating the fluids are preferably located in the tubular string below the ocean floor. This is preferred because these plugs have a diameter large enough to wipe the inner diameter of the tubular string extending below the ocean floor, and this tubular string (and thus each plug) typically has a larger diameter than need be used for connecting this string with the equipment on the rig at the ocean's surface. Thus, the cement slurry is preferably pumped from the surface through a string of drill pipe smaller than the string being cemented, which smaller string extends between the surface rig and the downhole string to be cemented. This creates the need for a second type of plug container that houses elements, which may broadly be called "plugs" also, which are of smaller diameter to permit these plugs to pass through the narrower connecting string and into the downhole cementing plugs. A system using this technique is the Halliburton Energy Services' sub-surface release system ("SSR Cementing Plug Method"). This system provides a means of wiping different pipe sizes; therefore, smaller diameter drill pipe can be used as described instead of the larger diameter casing that otherwise would be run between the rig floor and the ocean floor.

This prior art system will be briefly explained with reference to FIGS. 1–3. These drawings schematically illustrate the sequence of operation.

FIG. 1 shows bottom and top cementing plugs 2, 4, respectively, installed at the top of casing 6 (i.e., the tubular string in the well bore) prior to beginning the actual cementing operation. A set of releasing pins attaches the bottom cementing plug 2 to the top cementing plug 4.

A weighted plastic or bronze ball 8 housed in a surface plug container 10 is dropped through connecting drill pipe 12 ahead of the cement slurry. The ball 8 passes through a wider axial channel of the top plug 4 and lands on a seat of the bottom plug 2. A differential pressure applied through the drill pipe 12 from the surface separates the thus sealed bottom plug 2 from the top plug 4.

FIG. 2 illustrates how the bottom plug 2 has been discharged from the top plug 4 and seated on a float collar 14 (or float shoe). At this point, a small increase in pressure exposes port holes in the plug 2 so that the cement slurry can be pumped around the bottom plug releasing ball 8.

A double collet releasing mechanism holds the top plug 4 in place and permits circulation through the top cementing plug 4 at normal displacement rates prior to release of the top plug 4. To release the top cementing plug 4, a top releasing plug 16 from the surface plug container 10 is pumped down the drill pipe 12 behind the slurry and into the top cementing plug 4 where it latches and seals therewith. An applied pressure shears releasing pins to enable the top plug 4 to move down the casing 6.

As shown in FIG. 3, the top cementing plug 4 lands on the bottom cementing plug 2 to shut off flow in conventional manner.

Another relevant prior system is schematically illustrated in FIG. 4. This represents the Halliburton Energy Services' selective release system ("SR Plug System"). This system makes it possible to perform a multiple stage cementing job on ocean floor completions or conventional land liner jobs using a Halliburton Multiple Stage Cementer and three plugs.

The SR Plug System comprises a first stage top plug 18, an opening plug 20, and a closing plug 22, all of which are located downhole as in the SSR Cementing Plug Method. These are respectively released by suitable drill pipe plugs initially contained in a surface/rig floor located plug container 24. The system is called selective release because it is designed so that the upper downhole plugs cannot be released until after the lower downhole plugs are released.

It is to the SSR Cementing Plug Method and the SR Plug System that the present invention is particularly directed. More specifically, the present invention is directed to the surface plug containers 10, 24. Although the foregoing systems have been successfully used, the surface plug containers 10, 24 have been of the manifold type as shown by manifold 26 in FIGS. 1–3 and manifold 28 in FIG. 4. Such manifolds have shortcomings. For example, if a fluid line is connected to a manifold, the manifold cannot be rotated. Valves are required in a manifold to direct fluid flow; these add weight, expense and maintenance to the plug container, and additional pressure lines are needed to operate the valves remotely. A manifold restricts flow area, and a manifold can cause the plug container to tilt off-center, making it harder to stab into casing or drill pipe.

Accordingly, there is the need for an improved plug container that can be used without the manifolds 26, 28 to overcome the aforementioned shortcomings.

SUMMARY OF THE INVENTION

The present invention overcomes the above-noted and other shortcomings of the prior art by providing a novel and improved plug container with fluid pressure responsive cleanout. Advantageous features of this invention include a simpler design, less maintenance, less weight, shorter swing radius, larger flow area and less expensive than at least some other types of plug containers. Two specifically significant features of the present invention are its fluid pressure responsive cleanout and its single body hose connection for conducting the pressurized fluid to the locus of application. The former enables remote control of the cleanout process, and the latter reduces the chance for error is assembling the plug container.

The plug container of the present invention broadly comprises a housing. Disposed in the housing is a plug holder. The plug holder is releasably disposed in the housing so that in response to being released the plug holder moves from a first location within the housing, wherein fluid flow along an outside of the plug holder is permitted, to a second location within the housing, wherein fluid flow along the outside of the plug holder is blocked. The plug container further comprises fluid pressure responsive means, responsive to fluid pressure communicated into the housing, for moving the plug holder from the second location to permit fluid flow along the outside of the plug holder.

The plug container can be defined more specifically as comprising: a housing; a bypass sleeve slidably disposed within the housing at a bottom end thereof so that the bypass sleeve is movable within the housing between a lower position and an upper position; a plug retaining sleeve disposed within the housing, the plug retaining sleeve having a radial opening defined at a lower end thereof; a plug release plunger connected to the housing for holding the plug retaining sleeve at a spaced location above the bypass sleeve and for releasing the plug retaining sleeve therefrom so that the plug retaining sleeve drops and engages the bypass sleeve with the radial opening of the plug retaining sleeve blocked by the housing in response to the bypass sleeve in the lower position; and means for communicating a fluid to the bypass sleeve, wherein the fluid is pressurized for moving the bypass sleeve, and the plug retaining sleeve when engaged therewith, upwardly to the upper position within the housing so that the radial opening of the plug retaining sleeve is unblocked, whereby fluid flow along and through the plug retaining sleeve is permitted in response to the pressurized fluid communicated to the bypass sleeve.

In a particular implementation, the housing includes an upper mandrel, a single member main body connected to the upper mandrel, and a lower mandrel connected to the main body. In this implementation, the means for communicating a fluid includes a hose connected only to the single member main body so that the hose can remain connected during assembly and disassembly of the main body relative to the upper mandrel and the lower mandrel.

The present invention provides a related method, specifically a method of establishing fluid flow in a plug container. This method comprises releasing a plug holder in a housing so that the plug holder moves downward in the housing into engagement adjacent a bypass sleeve disposed in the housing, wherein the plug holder has an opening defined therein and wherein the opening is blocked to fluid flow therethrough in response to the engagement adjacent the bypass sleeve when the bypass sleeve is in a lower position. The method further comprises flowing pressurized air into the housing and against the bypass sleeve to pneumatically lift the bypass sleeve and the released plug holder to a position wherein the opening defined through the plug holder is unblocked to fluid flow within the housing. Flowing pressurized air of the preferred embodiment includes communicating the air from a pressurized source, through a swivel, into the housing, through a hose connected to a single member of the housing, and back into the housing and against the bypass sleeve.

Therefore, from the foregoing, it is a general object of the present invention to provide a novel and improved plug container with fluid pressure responsive cleanout. Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIG. 6 is a view along line 6—6 in FIG. 5B.

DETAILED DESCRIPTION OF PREFERRED EMBODIMENT

The preferred embodiment plug container 100 of the present invention can be used in place of the plug container 10 or 24 shown in FIGS. 1–4. The structure of the preferred embodiment plug container 100 will be described with reference to FIGS. 5 and 6. The operation will be described with reference also to FIGS. 7 and 8.

Figure 1:
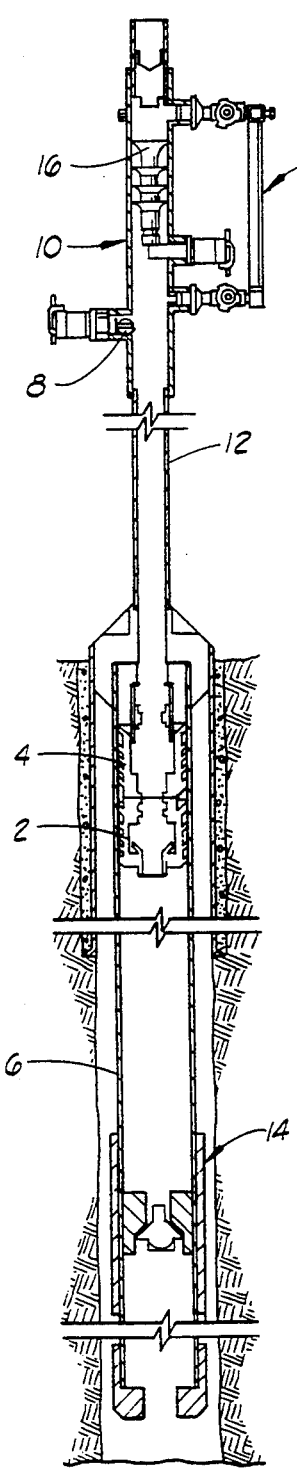
FIG. 1 PRIOR ART
FIG. 1 is a schematic illustration of a prior art cementing plug system with which the preferred embodiment of the present invention can be used.
Figure 2:
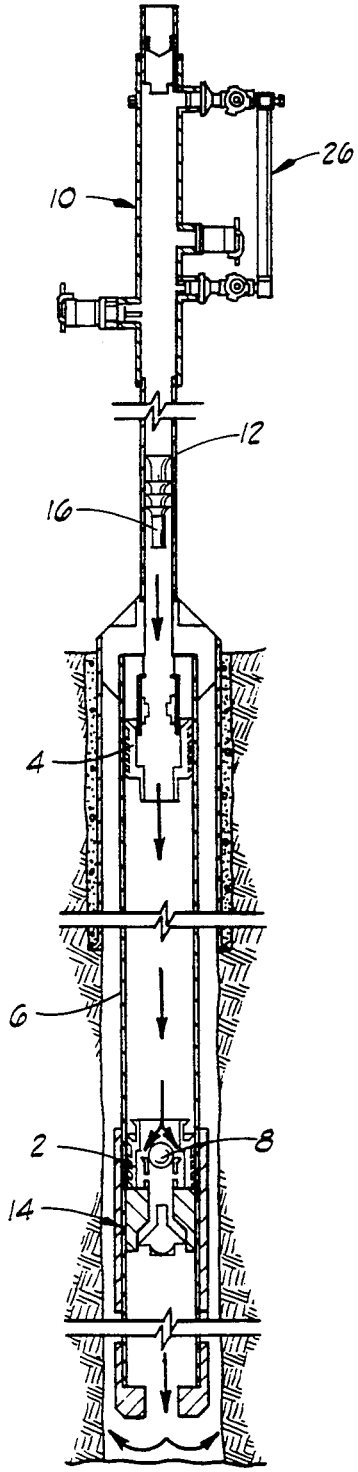
FIG. 2 PRIOR ART
FIG. 2 is a schematic illustration of the prior art cementing plug system of FIG. 1 showing one phase of operation.
Figure 3:
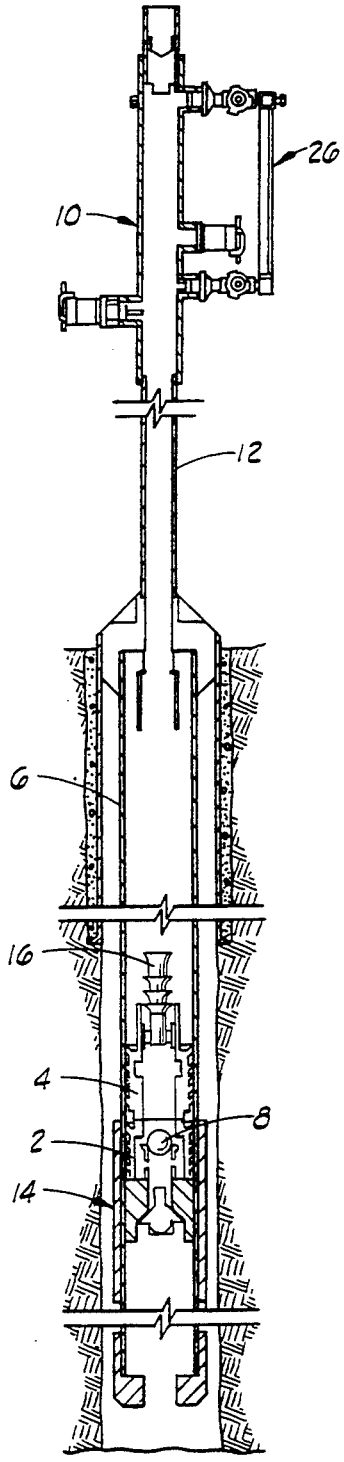
FIG. 3 PRIOR ART
FIG. 3 is a schematic illustration of the prior art cementing plug system of FIG. 1 showing another phase of operation.
Figure 4:
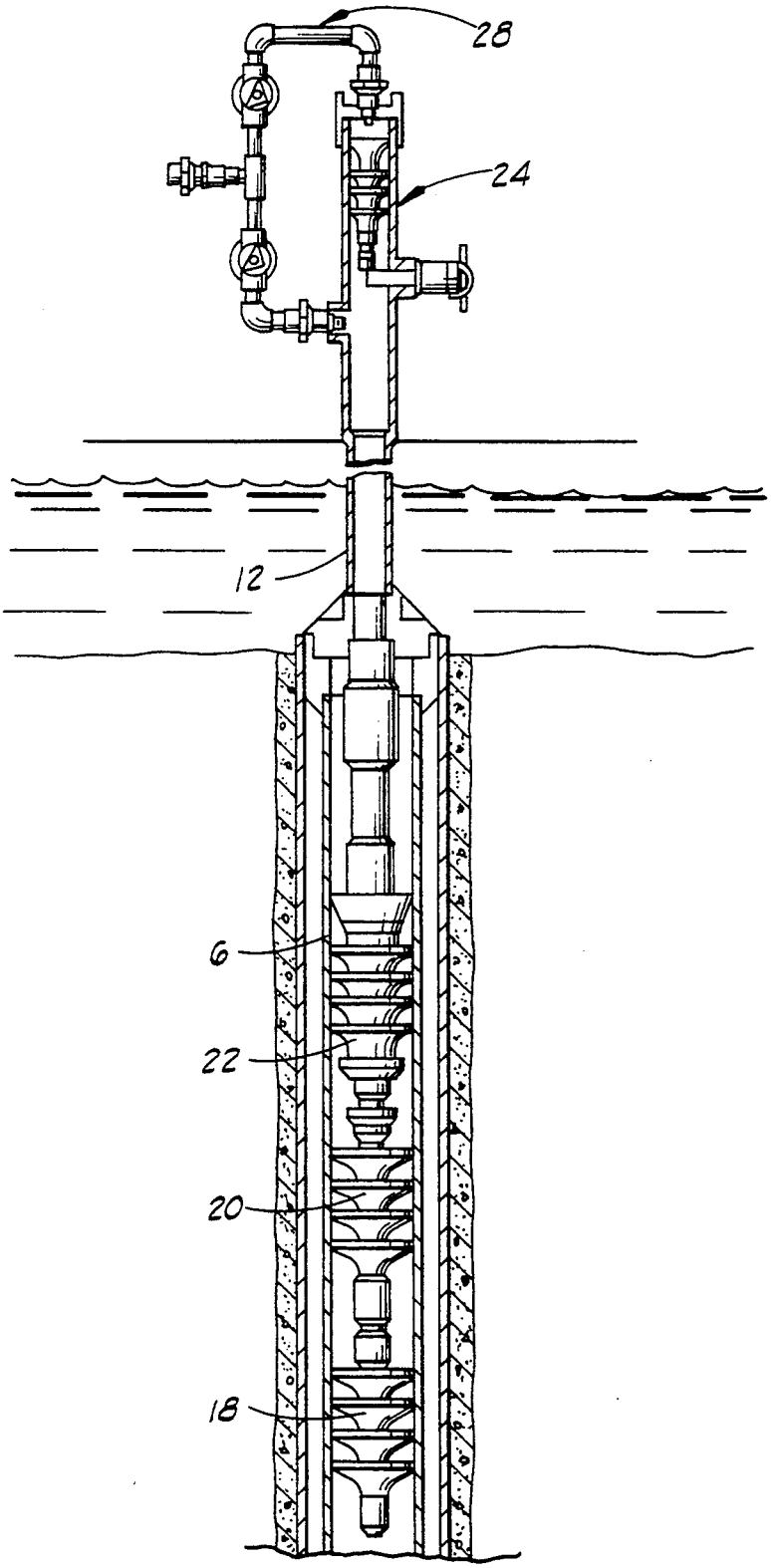
FIG. 4 PRIOR ART
FIG. 4 is a schematic illustration of another prior art cementing plug system with which the preferred embodiment of the present invention can be used.
Figure 5A:
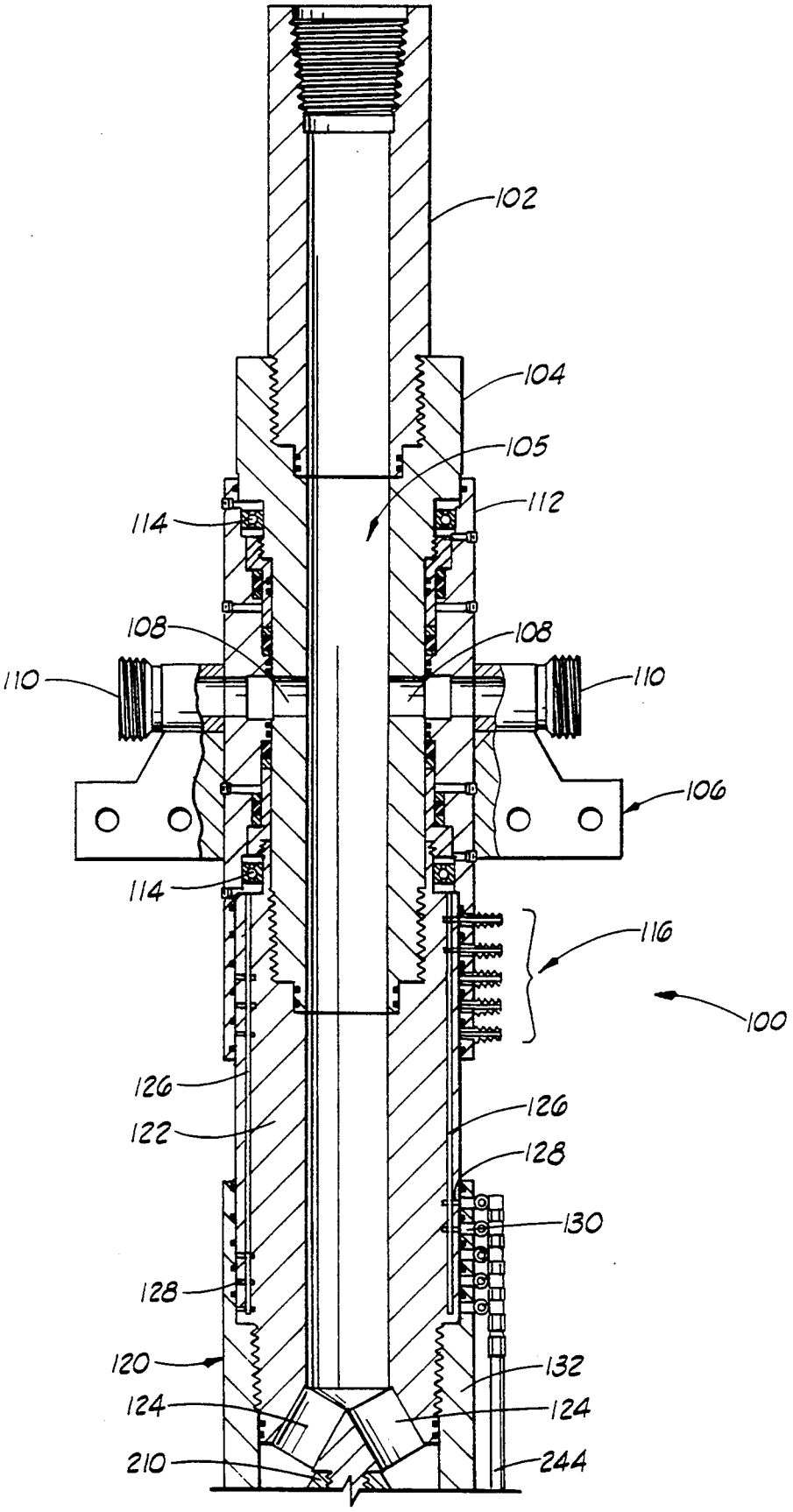
FIGS. 5A–5C are a longitudinal sectional view of the preferred embodiment plug container of the present invention.

The plug container 100 includes an upper adapter 102 (FIG. 5A) having a hollow interior through which a primary fluid (e.g., cement slurry, displacing fluid, etc.) can flow. The upper end of the hollow interior is threaded to couple with a top drive unit (not shown) of a type known in the art. The lower end of the upper adapter 102 is externally threaded for coupling with a rotatable portion 104 of a swivel assembly 106 (FIG. 5A).

The rotatable portion 104 is a cylindrical mandrel which has an axial opening 105 through which the primary fluid can flow. The rotatable portion 104 has radial openings 108 which communicate the axial opening 105 with hose connector ports 110 forming part of a stationary portion 112 of the swivel assembly 106. The rotatable portion 104 is journaled in the stationary portion 112 by upper and lower bearings 114 so that the rotatable portion 104 can rotate within the stationary portion 112.

The hose connector ports 110 provide for a cement slurry or a displacing fluid or a clean out fluid to be injected into the plug container 100 via the swivel assembly 106.

The stationary portion 112 of the swivel assembly 106 also has means for connecting to a source of pressurized fluid. This connecting means includes one or more ports 116. In the preferred embodiment, the source of pressurized fluid is air so that the ports 116 connect with pneumatic hoses.

The stationary portion 112 of the swivel assembly 106 allows the fluid ports 110, 116 and connecting lines to remain stationary when fluid is pumped and the plug container 100 is rotated. The swivel assembly 106 also allows pneumatic pressure to be applied to subsequently described plug release plungers and a bypass sleeve of the plug container 100 even when the plug container 100 is rotated.

Rotation of the plug container 100 can occur because the remainder of it is connected to an external thread at a lower end of the rotatable portion 104 of the swivel assembly 106. This connected portion of the plug container 100 includes a housing 120. More particularly, an upper mandrel 122 (FIG. 5A) of the housing 120 is connected to the rotatable portion 104. The upper mandrel 122 has an axial channel through which the primary fluid flows. This flow is diverted through lower ports 124 defined at the bottom of the upper mandrel 122.

The upper mandrel 122 also has longitudinal channels 126 defined therein. These communicate with one or more of the ports 116 of the swivel assembly 106. The channels 126 communicate at their respective upper ends with the ports 116. The lower ends of the channels 126 communicate with radial ports 128 defined in the upper mandrel 122. The radial ports 128 also communicate with radial ports 130 defined in the top end of a single member main body 132 (FIGS. 5A and 5B) of the housing 120. The ports 128, 130 communicate when the main body 132 is threaded on the lower end of the upper mandrel 122.

Figure 5B:
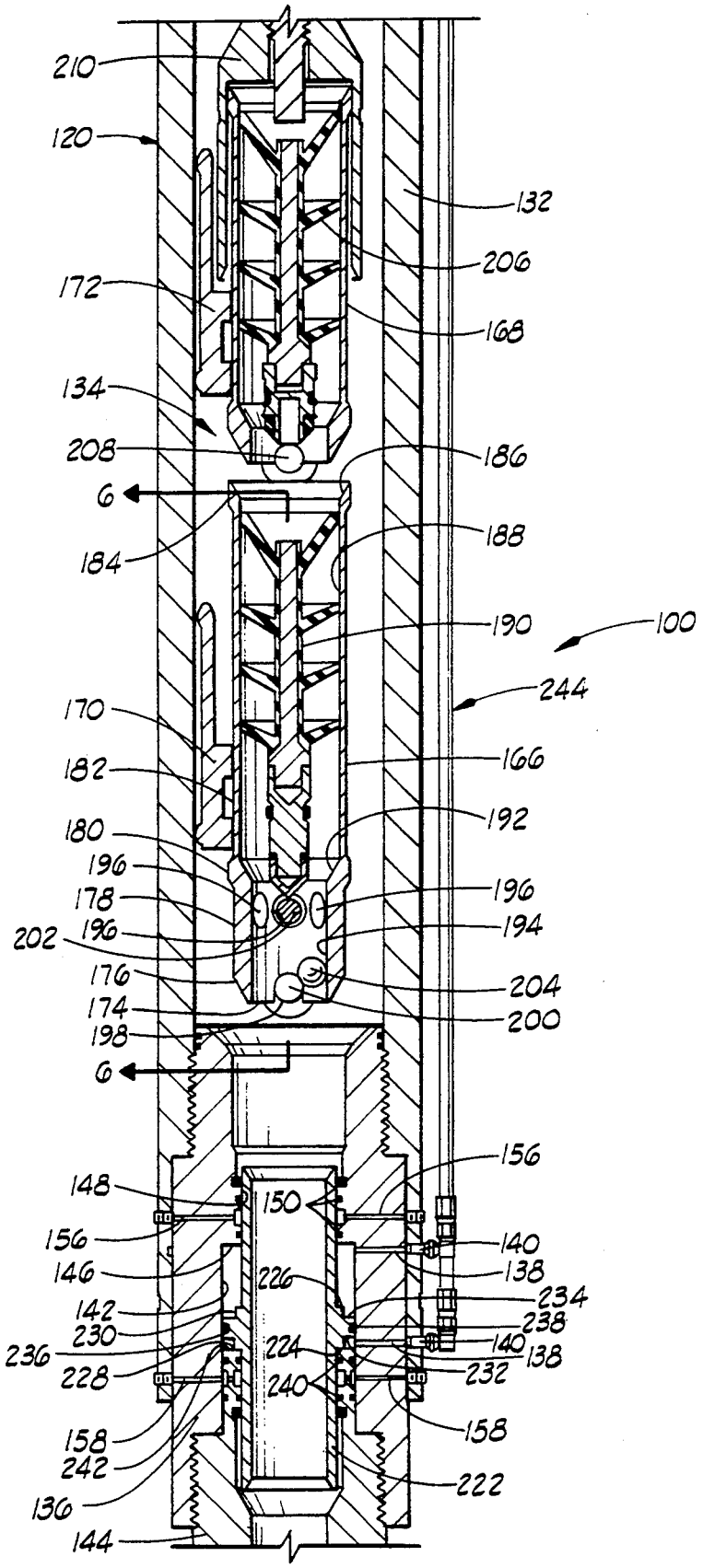

Referring to FIG. 5B, the main body 132 is cylindrical, as are the other body portions described hereinabove. The main body 132 also has an axial hollow interior defining a cylindrical plug holder receiving chamber 134.

The bottom end of this chamber 134 communicates with a lower mandrel 136 (FIG. 5B) of the housing 120 as the lower mandrel 136 is threadedly connected to the bottom end of the main body 132. Radial passages 138 are defined in the wall of the lower mandrel 136. These passages or ports 138 communicate with radial ports 140 defined through the wall at the bottom end of the main body 132. The radial ports 138 open within the interior of the lower mandrel 136 through a cylindrical inner surface 142.

The surface 142 terminates at its lower end at a threaded coupling that receives and connects with a lower adapter 144. The other end of the surface 142 terminates at a radially inwardly extending annular surface 146. The opposite edge of the surface 146 intersects a cylindrical surface 148 in which seal members 150 are disposed. The surface 148 transitions into the upper mouth of the axial channel defined through the lower mandrel 136. The surface 148 opens into radial ports 156 through which grease or other suitable lubricant can be injected.

The lower mandrel 136 also has radial lubrication ports 158 defined between the ports 138 and the lower end of the lower mandrel 136.

Figure 5C:
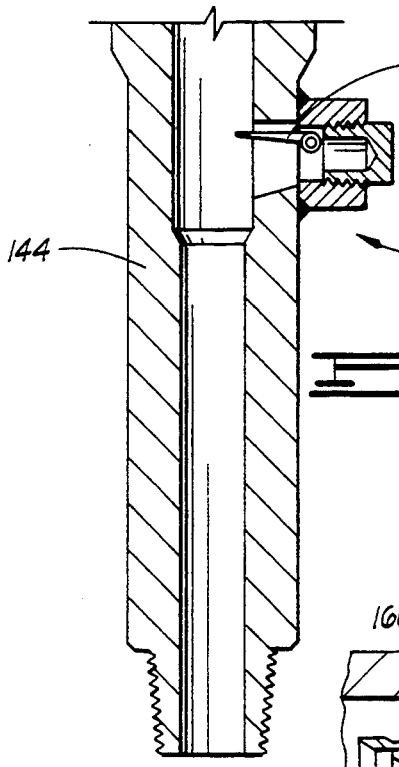
Figure 5:
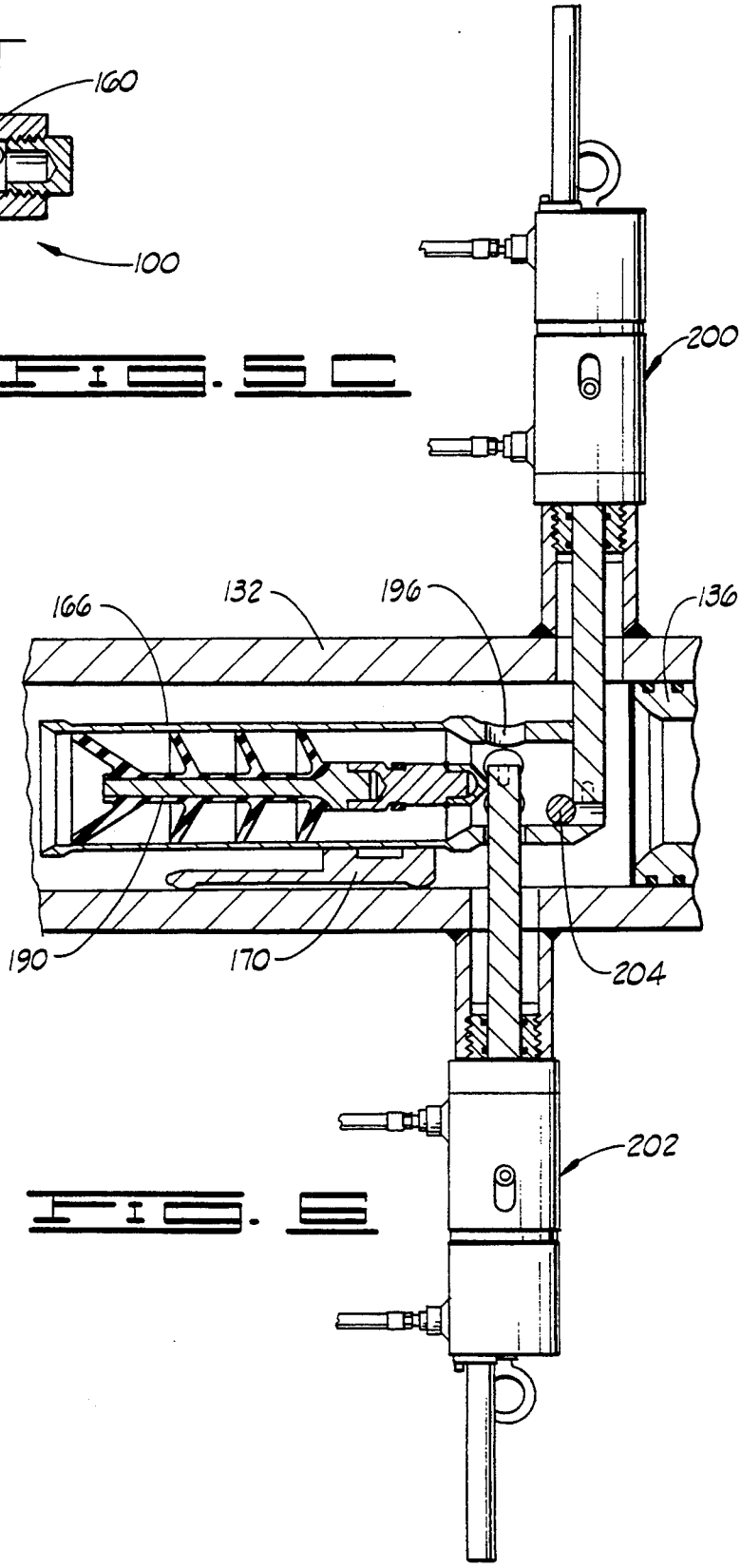

Referring to FIG. 5C, the lower adapter 144 connected to the lower mandrel 136 houses any suitable plug indicator device for detecting the passage of plugs from the plug container 100. This device includes a conventional mechanical arm 160 in FIG. 5C. The lower end of the lower adapter 144 has a threaded pin end to connect to the drill string 12 when the present invention is used with the systems of FIGS. 1-4. The lower adapter 144 has a hollow interior extending axially therethrough in communication with the axially aligned hollow interiors of the previously described body members.

The plug container 100 further comprises one or more plug holders releasably mounted within the chamber 134 of the main body 132 of the housing 120. Two such plug holders are shown in FIG. 5B. One is defined by a lower plug retaining sleeve 166 and the other is defined by an upper plug retaining sleeve 168. Each of these is spaced from the inner surface of the main body 132 by respective spacer members 170, 172 welded to the outer surfaces of the plug retaining sleeves 166, 168.

The lower plug retaining sleeve 166 has a bottom edge 174 from which an annular beveled surface 176 extends. An outer cylindrical surface 178 extends from the surface 176. A shoulder 180 extends radially outward from the surface 178 and an upper cylindrical surface 182. The surface 182 terminates at an upper rim 184 having an internal annular beveled surface 186.

Extending from the inner edge of the surface 186 is a cylindrical surface 188. The surface 188 defines an interior region of the sleeve 166 wherein a plug, specifically a releasing dart 190, is received.

From the lower end of the surface 188, a surface 192 tapers inwardly to a cylindrical surface 194. One or more openings 196 are defined radially between the surfaces 194, 178. At least one opening 198 is similarly defined. The opening 198 receives the plunger from a plug release plunger 200 and one of the openings 196 receives the plunger of a plug release plunger 202 as more clearly shown in FIG. 6. The plunger 200 supports a sealing ball 204 shown in FIGS. 5B and 6. The plug release plunger 202 supports the dart 190.

The upper plug retaining sleeve 168 is similar to the lower sleeve 166; however, as shown in FIG. 5B, the lower tip portion is shorter in that it does not have the outer cylindrical surface 178 and the inner cylindrical surface 194. The upper sleeve 168 receives a releasing dart 206. In a specific implementation, the dart 206 has a rubber wiper body with the same outer diameter as the rubber wiper body of the dart 190, but the dart 206 has an aluminum nose with a greater outer diameter than the aluminum nose of the dart 190; thus, the dart 190 can pass through a downhole plug or other object sized to receive and stop the larger nose of the dart 206. Both the sleeve 168 and the dart 206 are releasably supported by a plug release plunger 208.

A cylindrical cap 210 (FIG.5B) is connected to the upper mandrel 122 (FIG. 5A). When the upper sleeve 168 is on the plug release plunger 208, the top end of the upper sleeve 168 is received in a cavity of the cap 210 and flow of primary fluid through the chamber 134 goes around the outside of the upper sleeve 168.

The plug container 100 still further comprises fluid pressure responsive means for moving the one or more plug holders from lower, released positions or locations, to be subsequently described, to permit fluid flow along the outside of the plug holder(s) after they have been released. This means is implemented in the preferred embodiment by a bypass sleeve 222 (FIG. 5B). The bypass sleeve 222 is a cylindrical member having opposing annular surfaces 224, 226 extending from the main exterior surface of the bypass sleeve 222. Cylindrical surfaces 228, 230 extend towards each other from the respective surfaces 224, 226. An annular surface 232 extends radially outward from the surface 228, and an annular surface 234 extends radially outward from the surface 230. A cylindrical surface 236 extends between the annular surfaces 232, 234. A sealing member 238 is received in a groove defined in the surface 236.

The upper portion of the bypass sleeve 222 is sealingly received by the seals 150 and lubricated via the ports 156. The lower portion of the bypass sleeve 222 is received by seals 240 disposed in the upper end of the lower adapter 144, and the lower portion is lubricated via the ports 158. The bypass sleeve 222 is movable within these sealed relationships between a lower position shown in FIG. 5B wherein the surface 224 abuts an upper annular surface 242 of the lower adapter 144. In its uppermost position shown in FIG. 8, the annular surface 226 abuts the annular surface 146 of the lower mandrel 136. This movement occurs in response to pressure applied through one of the passages 138 as further described below.

The plug container 100 also comprises means for communicating a fluid to the bypass sleeve 222. This means is defined in the preferred embodiment by one or more of the longitudinal channels 126 of the upper mandrel 122 (FIG. 5A). This means is further defined by one or more hoses 244 connected between the ports 130, 140 of the main body 132 (FIGS. 5A and 5B). This means is still further defined by the radial passages 138 defined in the lower mandrel 136 (FIG. 5B). It is through the flow path established by these elements and the associated ports that pressurized fluid, specifically air, from a source connected to the ports 116 (FIG. 5A) of the stationary portion 112 of the swivel assembly 106 is applied to either the surface 232 or the surface 234 of the bypass sleeve 222 (FIG. 5B) whereby the bypass sleeve 222 is moved between its upper and lower positions, respectively.

Of the aforementioned fluid communicating means, it is a particular advantage of the present invention that the pneumatic hose(s) 244 are connected only to the single member main body 132. Thus, the hose(s) 244 do not need to be disconnected, and possibly misplaced or improperly reconnected, during assembly or disassembly of the remainder of the plug container 100.

During operation, the plug container 100 is made up on a top drive unit. Drill pipe, such as 12 in FIGS. 1–4, is made up on the bottom of the plug container 100. Fluid lines and pneumatic hoses are connected at 110, 116, respectively, of the swivel assembly 106 shown in FIG. 5A. The pneumatic lines connected to the ports 116 control both the plug release plungers 200, 202,208 and the bypass sleeve 222. This control can be effected remotely from the plug container 100 so that a person need not be physically adjacent the plug container 100 to obtain the following operation, which clearly provides a safety advantage over plug containers which are manually or otherwise locally operated adjacent the plug container.

FIG. 5B shows the position of the respective elements of the plug container 100 in a "loaded" or a "ready-to-use" configuration. That is, the plug container 100 is loaded with the ball 204 and the releasing darts 190, 206 and these elements are held by their respective plug release plungers. When the ball 204 is to be released to seal in a lower downhole plug such as shown in the configurations of FIGS. 1–4, the plug release plunger 200 is retracted in known manner under pneumatic control through a selected one or more of the ports 116 of the swivel assembly 106, whereby the ball 204 drops through the axial opening defined through the plug container 100 and travels downhole for sealing with a lower downhole cementing plug in known manner as referred to above.

When the lower dart 190 is to be released to engage the next downhole cementing plug, the plug release plunger 202 is retracted. This releases both the sleeve 166 and the dart 190. In response to cement (for example) being pumped behind the dart 190, it is carried down and out of the plug container 100 into the lower structure in the well. The sleeve 166, however, stops when it engages the bypass sleeve 222 and/or the lower mandrel 136. A similar reaction occurs when the plug release plunger 208 is retracted. The upper sleeve 168 drops into engagement with the lower sleeve 166 and the releasing dart 206 is pumped out of the plug container 100 for use downhole in a known manner. The lower sleeve 166 has the external shoulder 180 which, when the lower sleeve 166 drops, seals against the top end of the lower mandrel 136. The upper sleeve 168 has a taper on the bottom end which, when the upper sleeve 168 drops, seals against the top end of the lower sleeve 166. The configuration of the relevant portion of the plug container 100 resulting from these actions is shown in FIG. 7.

Figure 7:
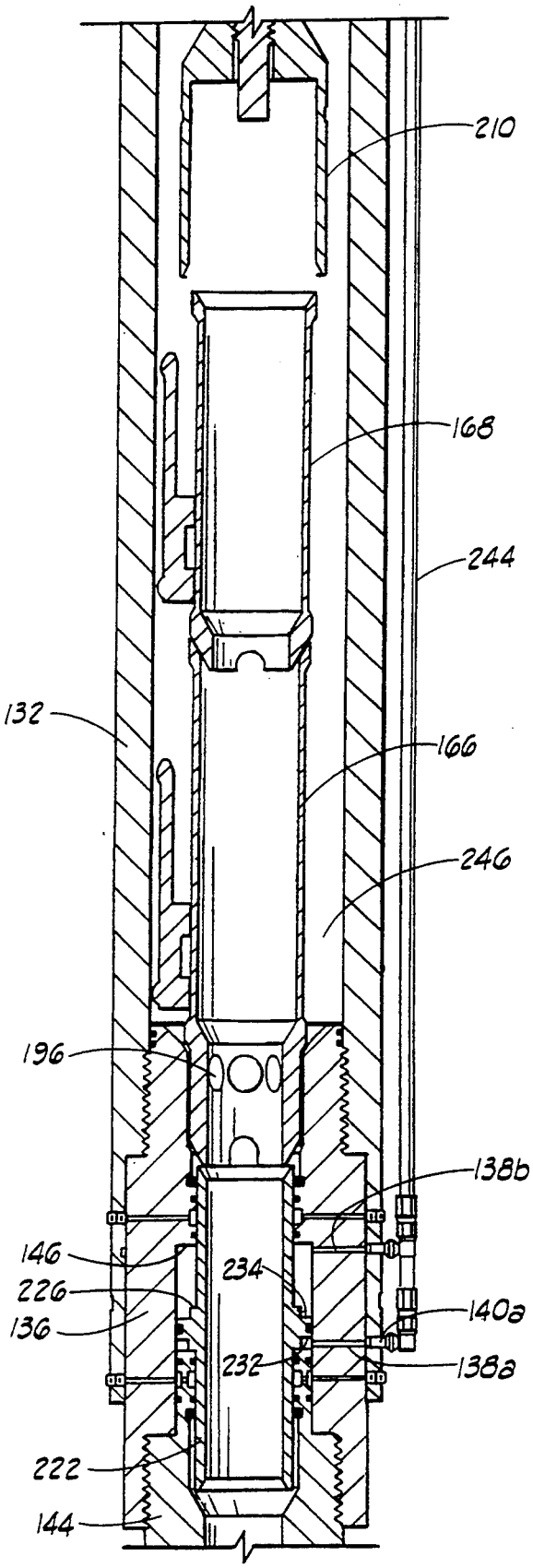
FIG. 7 is a view as in FIG. 5B but showing another phase of operation of the plug container of the present invention.
Figure 8:
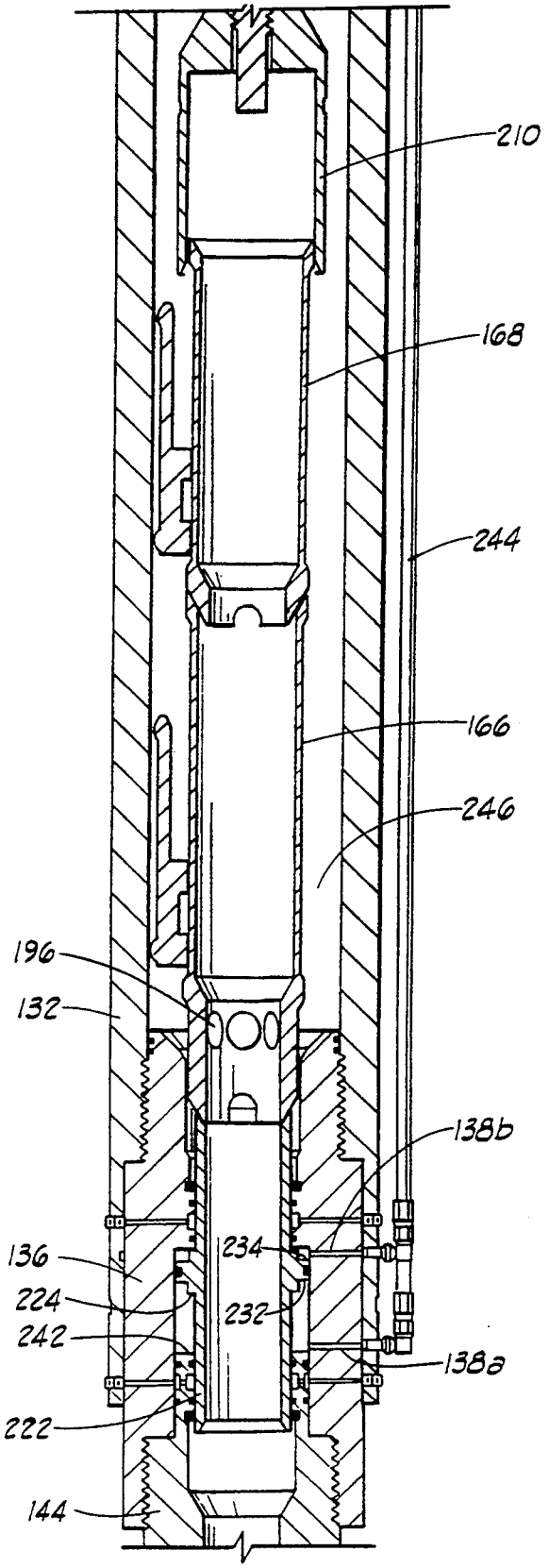
FIG. 8 is a view as in FIG. 5B but showing still another phase of operation of the plug container of the present invention.

In the configuration of FIG. 7, it is to be noted that the radial ports 196 defined through the lower end of the lower sleeve 166 are blocked to fluid flow since they are adjacent an inner surface of the lower mandrel 136 and the shoulder 180 of the lower sleeve 166 seals with the top of the lower mandrel 136. Thus, it will be apparent that cement or other fluid which has been pumped through the plug container 100 will fill an annulus 246 of the chamber 134 as shown in FIG. 7. If this is cement, it can harden if it is not cleaned out.

To enable such clean-out to occur, the present invention incorporates the pressure responsive means implemented by the bypass sleeve 222. With the plug container 100 in the configuration shown in FIG. 7, pressurized fluid is applied through the ports 116 of the swivel assembly 106. In the preferred embodiment, this fluid source is pressurized air. This pressurized air is communicated through at least one channel 126 of the upper mandrel 122, at least one pneumatic hose 244 connected to at least one lower passage 138 (specifically port 138*a* in FIG. 7) of the lower mandrel 136 so that pressure is applied to the surface 232 of the bypass sleeve 222. The upper passage 138*b* (FIG. 7) defined through the lower mandrel 136 is vented to atmosphere (or other environment having lower pressure than is applied to the surface 232) through the respective fluid conducting means of which it is a part. In response to the resultant pressure differential (e.g., a nominal 100 psi pressure differential), the bypass sleeve 222 moves upwardly, lifting the sleeves 166, 168. This moves the top of the upper sleeve 168 back into the cap 210 and it moves the radial ports 196 up so that they are again uncovered. Fluid is then directed around the outside of the sleeves 166, 168 and through the ports 196 at the bottom of the lower sleeve 168, cleaning out the annular space 246 and preventing cement from setting up therein.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A plug container, comprising:

a housing;

a plug holder releasably disposed in said housing so that in response to being released said plug holder moves from a first location within said housing, wherein fluid flow along an outside of said plug holder is permitted, to a second location within said housing, wherein fluid flow along the outside of said plug holder is blocked; and fluid pressure responsive means, responsive to fluid pressure communicated into said housing, for moving said plug holder from said second location to permit fluid flow along the outside of said plug holder.

2. A plug container as defined in claim 1, wherein:

said plug container further comprises a swivel having a stationary portion including connector means for connecting to a source of pressurized fluid, and said swivel further having a rotatable portion connected to said stationary portion so that said rotatable portion can rotate relative to said stationary portion;

said housing has a top end connected to said rotatable portion of said swivel; and said plug container further comprises means, defined in said housing, for communicating with said connector means so that pressurized fluid from the source is communicated through said swivel and said housing to said fluid pressure responsive means.

3. A plug container as defined in claim 2, wherein said housing includes:

an upper mandrel connected to said rotatable portion of said swivel, said upper mandrel having a channel defined therein in communication with said connector means;

a main body connected to said upper mandrel, said main body having an upper port and a lower port defined therein, said upper port communicating with said channel of said upper mandrel; and a lower mandrel connected to said main body, said lower mandrel having a passage defined therein in communication with said lower port of said main body and in communication with said fluid pressure responsive means.

4. A plug container, comprising:

a housing;

a bypass sleeve slidably disposed within said housing at a bottom end thereof so that said bypass sleeve is movable within said housing between a lower position and an upper position;

a plug retaining sleeve disposed within said housing, said plug retaining sleeve having a radial opening defined at a lower end thereof;

a plug release plunger connected to said housing for holding said plug retaining sleeve at a spaced location above said bypass sleeve and for releasing said plug retaining sleeve therefrom so that said plug retaining sleeve drops and engages said bypass sleeve with said radial opening of said plug retaining sleeve blocked by said housing in response to said bypass sleeve in said lower position; and means for communicating a fluid to said bypass sleeve, wherein said fluid is pressurized for moving said bypass sleeve, and said plug retaining sleeve when engaged therewith, upwardly to said upper position within said housing so that said radial opening of said plug retaining sleeve is unblocked, whereby fluid flow along and through said plug retaining sleeve is permitted in response to said pressurized fluid communicated to said bypass sleeve.

5. A plug container as defined in claim 4, wherein:

said housing includes an upper mandrel, a single member main body connected to said upper mandrel, and a lower mandrel connected to said main body; and said means for communicating a fluid includes a hose connected only to said single member main body so that said hose can remain connected during assembly and disassembly of said main body relative to said upper mandrel and said lower mandrel.

6. A plug container as defined in claim 4, wherein:

said plug container further comprises a swivel having a stationary portion including connector means for connecting to a source of pressurized fluid, and said swivel further having a rotatable portion connected to said stationary portion so that said rotatable portion can rotate relative to said stationary portion; and said means for communicating connects through said housing with said connector means so that pressurized fluid from the source is communicated through said swivel and said housing to said bypass sleeve.

7. A method of establishing fluid flow in a plug container, comprising:

releasing a plug holder in a housing so that the plug holder moves downward in the housing into engagement adjacent a bypass sleeve disposed in the housing, wherein the plug holder has an opening defined therein and wherein the opening is blocked to fluid flow therethrough in response to the engagement adjacent the bypass sleeve when the bypass sleeve is in a lower position; and flowing pressurized air into the housing and against the bypass sleeve to pneumatically lift the bypass sleeve and the released plug holder to a position wherein the opening defined through the plug holder is unblocked to fluid flow within the housing.

8. A method as defined in claim 7, wherein flowing pressurized air includes communicating the air from a pressurized source, through a swivel, into the housing, through a hose connected to a single member of the housing, and back into the housing and against the bypass sleeve.

* * * * *